US007501923B2

(12) United States Patent
Nakao et al.

(10) Patent No.: US 7,501,923 B2
(45) Date of Patent: Mar. 10, 2009

(54) IGNITION COIL HAVING PLUG CAP

(75) Inventors: Kengo Nakao, Kariya (JP); Norihito Fujiyama, Obu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/822,930

(22) Filed: Jul. 11, 2007

(65) Prior Publication Data

US 2008/0024258 A1 Jan. 31, 2008

(30) Foreign Application Priority Data

Jul. 26, 2006 (JP) ..... 2006-203827
Feb. 6, 2007 (JP) ..... 2007-027152

(51) Int. Cl.
*H01F 27/02* (2006.01)

(52) U.S. Cl. ..... 336/90; 336/92; 336/96

(58) Field of Classification Search ..... 336/60, 336/92, 96; 123/634–635
See application file for complete search history.

(56) References Cited

U.S. PATENT DOCUMENTS 6,836,203 B2 12/2004 Wada
2005/0242914 A1* 11/2005 Kawai et al. ..... 336/90

FOREIGN PATENT DOCUMENTS

JP 8-100753 4/1996
JP 2005277379 A * 10/2005

OTHER PUBLICATIONS

U.S. Appl. No. 11/822,929, filed Jul. 2007, Nakao et al.

* cited by examiner

*Primary Examiner*—Anh T Mai
(74) *Attorney, Agent, or Firm*—Nixon & Vanderhye PC

(57) ABSTRACT

An ignition coil includes primary and secondary coils accommodated in a coil case extending to define a cylindrical mount portion on a high voltage side. The mount portion includes a high voltage terminal electrically connected with the secondary coil. A coil spring electrically connects the high voltage terminal with a sparkplug. An electrically insulative plug cap is attached to the mount portion. The coil spring has a low voltage end electrically connected with the secondary coil via the high voltage terminal. The coil spring has a high voltage end in contact with a terminal of the sparkplug. The coil spring has an intermediate portion between the low voltage end and the high voltage end. The plug cap has a spring support portion, which is partially defining the fitting hole and restricting the intermediate portion of the coil spring from being radially deformed.

14 Claims, 7 Drawing Sheets

IGNITION COIL HAVING PLUG CAP

CROSS REFERENCE TO RELATED APPLICATIONS

This application is based on and incorporates herein by reference Japanese Patent Applications No. 2006-203827 filed on Jul. 26, 2006 and No. 2007-27152 filed on Feb. 6, 2007.

This application is related to U.S. patent applications (IP-ICS 105678-US) claiming priorities to the following Japanese Patent Applications, respectively:

No. 2006-203828 filed on Jul. 26, 2006; and

No. 2007-27153 filed on Feb. 6, 2007.

FIELD OF THE INVENTION

The present invention relates to an ignition coil having a plug cap.

BACKGROUND OF THE INVENTION

An engine is provided with an ignition coil having a coil main body constructed by, for example, coaxially providing a primary coil with a secondary coil. The primary coil is constructed by winding a wire around a primary spool to form a primary winding, and the secondary coil is constructed by winding a wire around a secondary spool to form a secondary winding. A center core, which is formed of a magnetic material, is provided on the radially inner side of the primary and secondary coils. An outer core, which is formed of a magnetic material, is provided on the radially outer side of the primary and secondary coils. Thus, the center core and the outer core construct a magnetic circuit.

The secondary coil has a high voltage end defining a plug mount portion to which a sparkplug is provided. The plug mount portion has a cap mount portion, which is in a cylindrical shape, and extends from a spool constructing the primary coil or the like. The cap mount portion is attached with a plug cap formed of rubber. The plug cap has a fitting hole accommodating a coil spring electrically conducted with a high voltage winding end of the secondary coil via a high voltage terminal. The sparkplug is mounted to The plug mount portion by fitting an insulator portion of the sparkplug into the fitting hole. The sparkplug has a terminal portion in contact with the coil spring.

For example, an ignition coil is disclosed in U.S. Pat. No. 6,836,203 B2 (JP-A-2003-163126). In this structure, an intermediate portion of the coil spring is not steadily supported, and the intermediate portion may be radially deformed.

When the intermediate portion is largely deformed, electric contact between the coil spring and the sparkplug may not be maintained. In addition, when the intermediate portion is largely deformed, high voltage electricity passing through the coil spring may leak to low voltage components.

According to JP-A-8-100753, an ignition coil includes an ignition coil portion (coil body) and a socket. The ignition coil portion (coil body) includes a primary coil and a secondary coil, and is located outside a plughole of an engine. The socket accommodates a spring electrically conducted with a high voltage winding end of the secondary coil. The socket is inserted into the plughole of the engine. In this structure, the socket supports the spring.

However, in this structure disclosed in JP-A-8-100753, the coil main body is outside the plughole, and this structure cannot be directly applied to a stick type structure in which the coil main body is inserted into the plughole.

SUMMARY OF THE INVENTION

In view of the foregoing and other problems, it is an object of the present invention to produce an ignition coil having a plug cap, the ignition coil adapted to maintaining conductivity relative to a sparkplug.

The present invention addresses the above disadvantage. According to one aspect of the present invention, an ignition coil for a sparkplug of an engine, the ignition coil including a coil main body including a coil case accommodating a primary coil and a secondary coil. The ignition coil further includes a plug mount portion provided to a high voltage end of the coil main body. The plug mount portion has a cap mount portion being in a substantially cylindrical shape extending from a primary spool of the primary coil or the coil case. The ignition coil further includes a plug cap, which is formed of rubber and connected with the cap mount portion. The plug cap has a fitting hole in which an insulator portion of the sparkplug is to be inserted. The ignition coil further includes a coil spring inserted in the fitting hole for electrically connecting the sparkplug with a high voltage terminal, which is connected with a high voltage winding end of a winding of the secondary coil. The plug mount portion and the coil main body are adapted to being inserted in a plughole of the engine. The coil spring has a low voltage end being electrically connected with the high voltage winding end of the secondary coil via the high voltage terminal. The coil spring has a high voltage end to be in contact with a terminal portion of a tip end of an insulator portion of the sparkplug. The coil spring has an intermediate portion between the low voltage end and the high voltage end. The plug cap has a spring support portion defining a part of the fitting hole for restricting the intermediate portion of the coil spring from being radially deformed.

According to another aspect of the present invention, an ignition coil for a sparkplug of an engine, the ignition coil including a coil main body including a coil case accommodating a primary coil and a secondary coil. The coil case has an inner gap charged with an electrically insulative resin. The ignition coil further includes a plug mount portion provided to a high voltage end of the coil main body. The plug mount portion has a cap mount portion in a substantially cylindrical shape extending from a spool of the primary coil or the coil case. The ignition coil further includes a plug cap being formed of rubber and having a circumferential mount portion being in a substantially cylindrical shape. The circumferential mount portion is attached to an outer circumferential periphery of the cap mount portion. The plug cap has a fitting hole in which an insulator portion of the sparkplug is to be inserted. The ignition coil further includes a coil spring inserted in the fitting hole, and at least partially supported by an inner circumferential periphery of the cap mount portion. The coil spring is adapted to electrically connecting the sparkplug with a high voltage terminal, which is connected with a high voltage winding end of a winding of the secondary coil. The plug mount portion and the coil main body are adapted to being inserted in a plughole of the engine. The coil spring has a low voltage end being electrically connected with the high voltage winding end of the secondary coil via the high voltage terminal. The coil spring has a high voltage end adapted to being in contact with a terminal portion of a tip end of an insulator portion of the sparkplug. The cap mount portion has a substantially annular space communicating with the inner gap in the coil case, and charged with the electrically insulative resin. The circumferential mount portion of the plug cap has a low voltage end on a low voltage side. The substantially annular space has a high voltage end located on the high voltage side with respect to the low voltage end of the circumferential mount portion.

According to another aspect of the present invention, an ignition coil adapted to being connected with a sparkplug and inserted in a plughole of the engine, the ignition coil including a coil case. The ignition coil further includes primary and secondary coils accommodated in the coil case. One of the coil case and a primary spool of the primary coil extends to define a mount portion in a substantially cylindrical shape on a high voltage side. The mount portion includes a high voltage terminal electrically connected with the secondary coil. The ignition coil further includes a coil spring adapted to electrically connecting the high voltage terminal with the sparkplug. The ignition coil further includes a plug cap being electrically insulative and having a circumferential portion attached to an outer circumferential periphery of the mount portion. The plug cap circumferentially surrounds the high voltage terminal and the coil spring. The plug cap is adapted to circumferentially surrounding an insulator portion of the sparkplug. The coil spring has a low voltage end being electrically connected with the secondary coil via the high voltage terminal. The coil spring has a high voltage end adapted to being in contact with a terminal portion of the insulator portion of the sparkplug. The coil spring has an intermediate portion between the low voltage end and the high voltage end. The plug cap has a spring support portion, which is partially defining the fitting hole and restricting the intermediate portion of the coil spring from being radially deformed.

According to another aspect of the present invention, an ignition coil adapted to being connected with a sparkplug and inserted in a plughole of an engine, the ignition coil including a coil case. The ignition coil further includes primary and secondary coils accommodated in the coil case. One of the coil case and a primary spool of the primary coil extends to define a mount portion in a substantially cylindrical shape on a high voltage side. The mount portion includes a high voltage terminal electrically connected with the secondary coil. The ignition coil further includes a coil spring adapted to electrically connecting the high voltage terminal with the sparkplug. The ignition coil further includes a plug cap being electrically insulative and having a circumferential portion attached to an outer circumferential periphery of the mount portion. The plug cap circumferentially surrounds the high voltage terminal and the coil spring, and being adapted to circumferentially surrounding an insulator portion of the sparkplug. The coil spring has a low voltage end being electrically connected with the secondary coil via the high voltage terminal. The coil spring has a high voltage end adapted to being in contact with a terminal portion of the insulator portion of the sparkplug. The coil spring is at least partially supported by an inner circumferential periphery of the mount portion. The mount portion has a substantially annular space communicating with an inner gap in the coil case, and charged with an electrically insulative resin. The electrically insulative resin charged in the substantially annular space has a high voltage resin end located on the high voltage side with respect to a low voltage end of the circumferential portion of the plug cap on a low voltage side.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
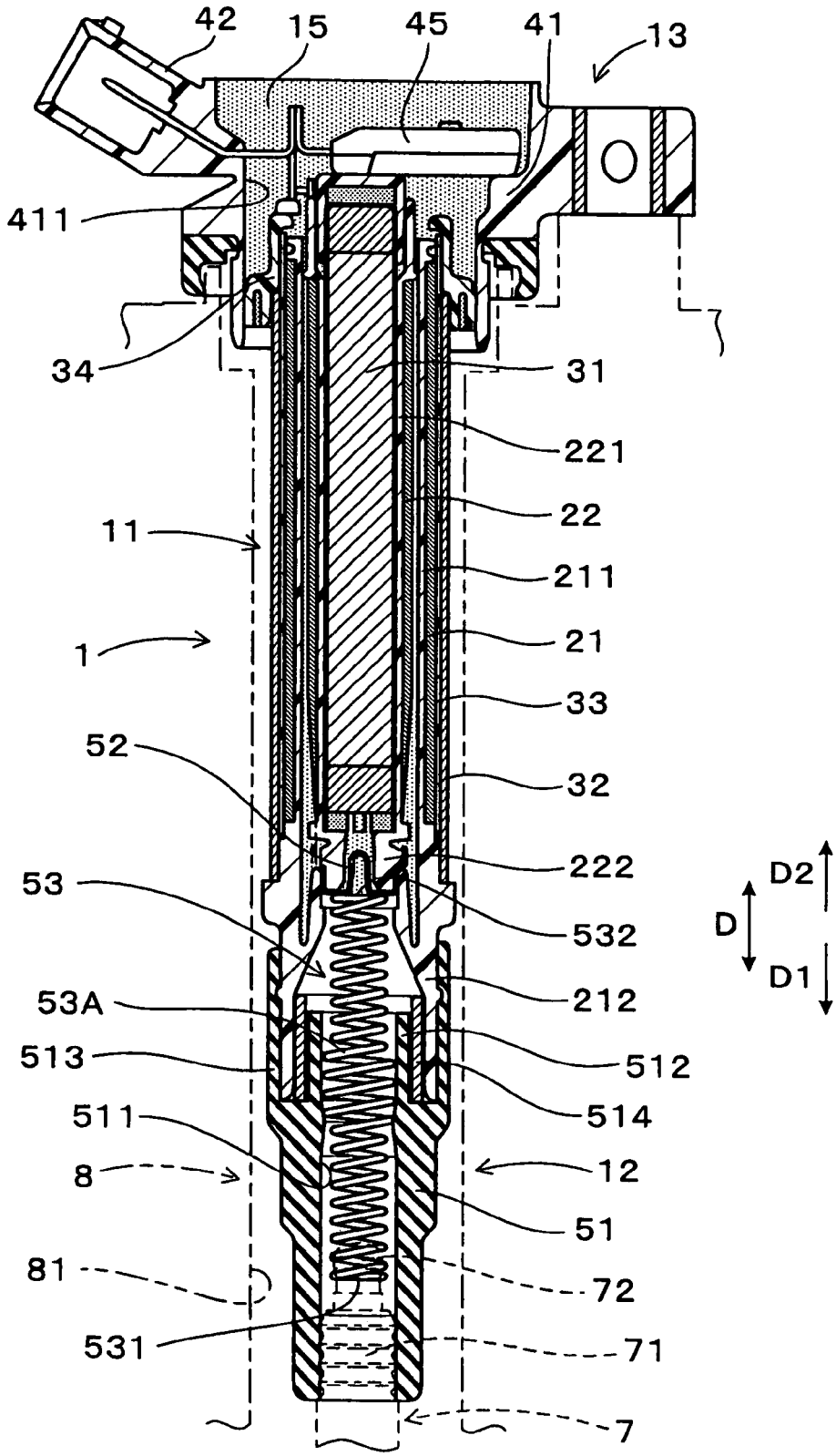
FIG. 1 is a sectional view showing an ignition coil according to a first embodiment.

In this embodiment, as shown in FIG. 1, an ignition coil 1 includes a coil main body 11 and a plug mount portion 12. The coil main body 11 includes a coil case 33 accommodating a primary coil 21 and a secondary coil 22. The plug mount portion 12 is provided to an end of the coil main body 11 on a high voltage side D1. The ignition coil 1 has a stick-type structure. Specifically, the plug mount portion 12 and the coil main body 11 are inserted into a plughole 81 of a cylinder head cover 8 of the engine. A substantially cylindrical cap mount portion (high voltage tower) 212 extends from a primary spool 211 of the primary coil 21. The plug mount portion 12 is constructed by providing a plug cap 51, which is formed of rubber, to the cap mount portion 212. The plug cap 51 has a fitting hole 511 into which an insulator portion 71 of a sparkplug 7 is fitted.

In this example, the low voltage side D2 is on the upper side in FIG. 1, i.e., on the foreside of the ignition coil 1 being inserted into the plughole 81 of the engine. The high voltage side D1 is on the opposite side of the low voltage side D2.

Figure 2:
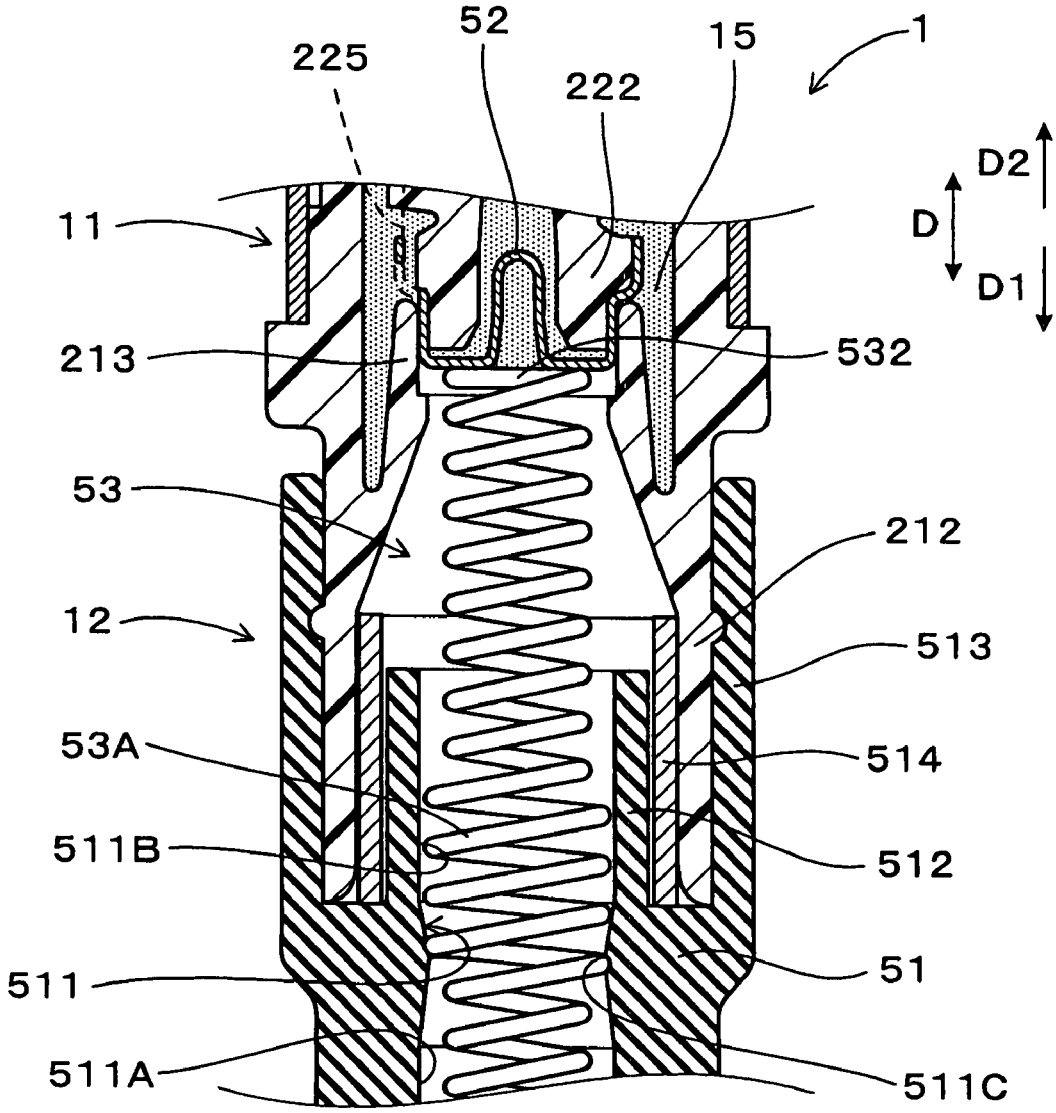
FIG. 2 is a sectional view showing a plug mount portion of the ignition coil according to the first embodiment.

As shown in FIG. 2, a coil spring 53 is provided in the fitting hole 511 of the plug cap 51. The coil spring 53 has a low voltage end (upper end, reference end) 532 conductive with a high voltage winding end 225 of the secondary coil 22 on a high voltage side via a high voltage terminal 52. The coil spring 53 has a high voltage end (lower end, tip end) 531 being in contact with a terminal portion 72 of a tip end of the insulator portion 71 of the sparkplug 7. A spring support portion 512 is provided in the fitting hole 511 of the plug cap 51 for restricting an intermediate portion 53A of the coil spring 53 from being radially deformed.

As follows, the ignition coil 1 is described with reference to FIGS. 1 to 2. Referring to FIG. 1, the ignition coil 1 has the plug mount portion 12 in an axial end of the coil main body 11 on the high voltage side D1. The ignition coil 1 has a connector portion 13 in another axial end of the coil main body 11 on the low voltage side D2. The ignition coil 1 is electrically connected with an external electronic control unit (ECU) of the engine via the connector portion 13. The coil main body 11 and the plug mount portion 12 are inserted into the plughole 81, and the connector portion 13 is located outside the plughole 81, when the ignition coil 1 is mounted.

The primary coil 21 is constructed by winding a wire, which is applied with electrically insulative coating, around the outer circumferential periphery of the primary spool 211. The primary spool 211 is, for example, formed of thermoplastic resin to have a substantially annular cross section. The secondary coil 22 is constructed by winding a wire, which is applied with electrically insulative coating, around the outer circumferential periphery of a secondary spool 221. The secondary spool 221 is, for example, formed of thermoplastic resin to have a substantially annular cross section. The secondary winding is smaller than the primary winding in diameter. The number of winding of the wire to construct the secondary winding around the secondary spool 221 is greater than the number of winding the wire to construct the primary winding around the primary spool 211.

Referring to FIG. 1, a substantially bar-shaped center core 31, which is formed of a magnetic material, is provided on the radially inner side of the primary coil 21 and the secondary coil 22. A substantially cylindrical outer core 32, which is formed of a magnetic material, is provided on the radially outer side of the primary coil 21 and the secondary coil 22. In this example, the secondary coil 22 is arranged on the radially inner side of the primary coil 21. The center core 31 is arranged on the radially inner side of the secondary coil 22. The coil case 33 is in a substantially cylindrical shape having a thin wall. The coil case 33 is arranged between the outer circumferential periphery of the primary coil 21 and the outer core 32. In this example, the center core 31 is formed by stacking substantially plate-shaped electromagnetic plates such as silicon steel plates with respect to the radial direction of the ignition coil 1 to have a substantially circular cross section. In this example, the outer core 32 is formed by radially stacking electromagnetic plates such as silicon steel plates along the outer circumferential periphery of the coil case 33 to have a substantially cylindrical cross section.

Referring to FIG. 2, the plug cap 51 has a substantially cylindrical circumferential mount portion 513 attached to the outer circumferential periphery of the cap mount portion 212. The spring support portion 512 is in a substantially cylindrical shape protruding toward the low voltage side D2 with respect to the axial direction D on the radially inner side of the circumferential mount portion 513. In this example, the spring support portion 512 is provided with a reinforce member 514 having hardness greater than hardness of a rubber material constructing the spring support portion 512. The circumferential mount portion 513 and the spring support portion 512 define therebetween a substantially annular groove. The reinforce member 514 is provided on the radially outer side of the spring support portion 512.

In this example, the high voltage terminal (secondary terminal) 52 is electrically connected with the high voltage winding end 225 of the secondary winding. A terminal mount portion 222 is provided to the end of the secondary spool 221 on the high voltage side D1. A support portion 213 is formed on the radially inner side of the cap mount portion 212 of the primary spool 211. The high voltage terminal 52 is interposed between the terminal mount portion 222 and the support portion 213. The high voltage winding end 225 of the secondary winding is electrically conducted with the terminal portion 72 of the sparkplug 7 via the high voltage terminal 52 and the coil spring 53. Referring to FIG. 1, the insulator portion 71 of the sparkplug 7 is inserted into the fitting hole 511 of the plug cap 51. The insulator portion 71 is fixed to the cylinder head cover 8 of the engine in a condition where the terminal portion 72 in the tip end of the insulator portion 71 is in contact with the high voltage end 531 of the coil spring 53.

Referring to FIG. 2, the spring support portion 512 has the inner circumferential periphery defining a fit portion 511A and a support portion 511B. The insulator portion 71 of the sparkplug 7 is inserted into the fit portion 511A. A small diameter portion 511C radially inwardly protrudes axially between the fit portion 511A and the support portion 511B in the fitting hole 511 of the plug cap 51. The diameter of the intermediate portion 53A of the coil spring 53 is greater than the diameter of the other portion of the coil spring 53. In this structure, the intermediate portion 53A of the coil spring 53 is inserted into the support portion 511B, so that the intermediate portion 53A hooks to the small diameter portion 511C. Thus, the coil spring 53 can be restricted from dropping from the fitting hole 511.

Referring to FIG. 1, the connector portion 13 is constructed by providing an igniter 45 in a connector case 41 for supplying electricity to the primary winding. The connector case 41 is formed of, for example, thermoplastic. A connector joint portion 42 radially extends from the connector portion 13. The igniter 45 has multiple conductive pins, which are respectively conduced with multiple conductive pins, which are insert-molded in the connector joint portion 42. The coil main body 11 is fitted into a fitting hole 411 of the connector case 41 via an engage member 34, which is formed of, for example, thermoplastic resin. The igniter 45 includes a power supply circuit for supplying electric power to the primary winding. The igniter 45 further includes an ion current detection circuit for detecting an ion current flowing in the secondary winding through a pair of electrodes of the sparkplug 7.

The ignition coil 1 has an inner gap charged with electrically insulative resin 15. In this example, the electrically insulative resin 15 is thermosetting resin such as epoxy resin. The electrically insulative resin 15 is formed by: assembling the components of the ignition coil 1; vacuuming the inner gap of the ignition coil 1; charging resin such as epoxy resin being in a liquid condition into the vacuum gap; and solidifying the epoxy resin.

The ECU transmits a pulse-shaped spark-generating signal to supply electricity to the primary winding, so that the center core 31 and the outer core 32 form therebetween a magnetic field. The ECU terminates the electricity supplied to the primary winding, so that the center core 31 and the outer core 32 form therebetween an inductive magnetic field opposite to the magnetic field. The inductive magnetic field generates induced high-voltage electromotive force (counter electromotive force) in the secondary wiring, so that the pair of electrodes of the sparkplug 7 of the ignition coil 1 sparks.

In this example, as described above, the spring support portion 512 protrudes from the plug cap 51 toward the low voltage side D2 with respect to the axial direction D. The reinforce member 514 is provided around the outer circumferential periphery of the spring support portion 512. In this structure, the reinforce member 514 enhances mechanical strength of the plug cap 51. Thus, the reinforced plug cap 51, which is formed of rubber and excellent in electrically insulative property, is capable of steadily supporting the intermediate portion 53A of the coil spring 53.

Thus, the intermediate portion 53A of the coil spring 53 can be restricted from being radially deformed, so that electric contact between the coil spring 53 and the terminal portion 72 of the sparkplug 7 can be maintained. Thus, high voltage electricity passing through the coil spring 53 can be restricted from leaking to low-voltage components. Thus, the ignition coil 1 having the stick coil structure is capable of steadily maintaining electric conduction relative to the sparkplug 7.

As unillustrated, the cap mount portion 212 may be formed by extending the coil case 33. In this structure, the cap mount portion 212 may be formed integrally with the coil case 33. Alternatively, in this structure, the cap mount portion 212 may be formed separately from the coil case 33, and the cap mount portion 212 may be connected with the coil case 33.

Second Embodiment

Figure 3:
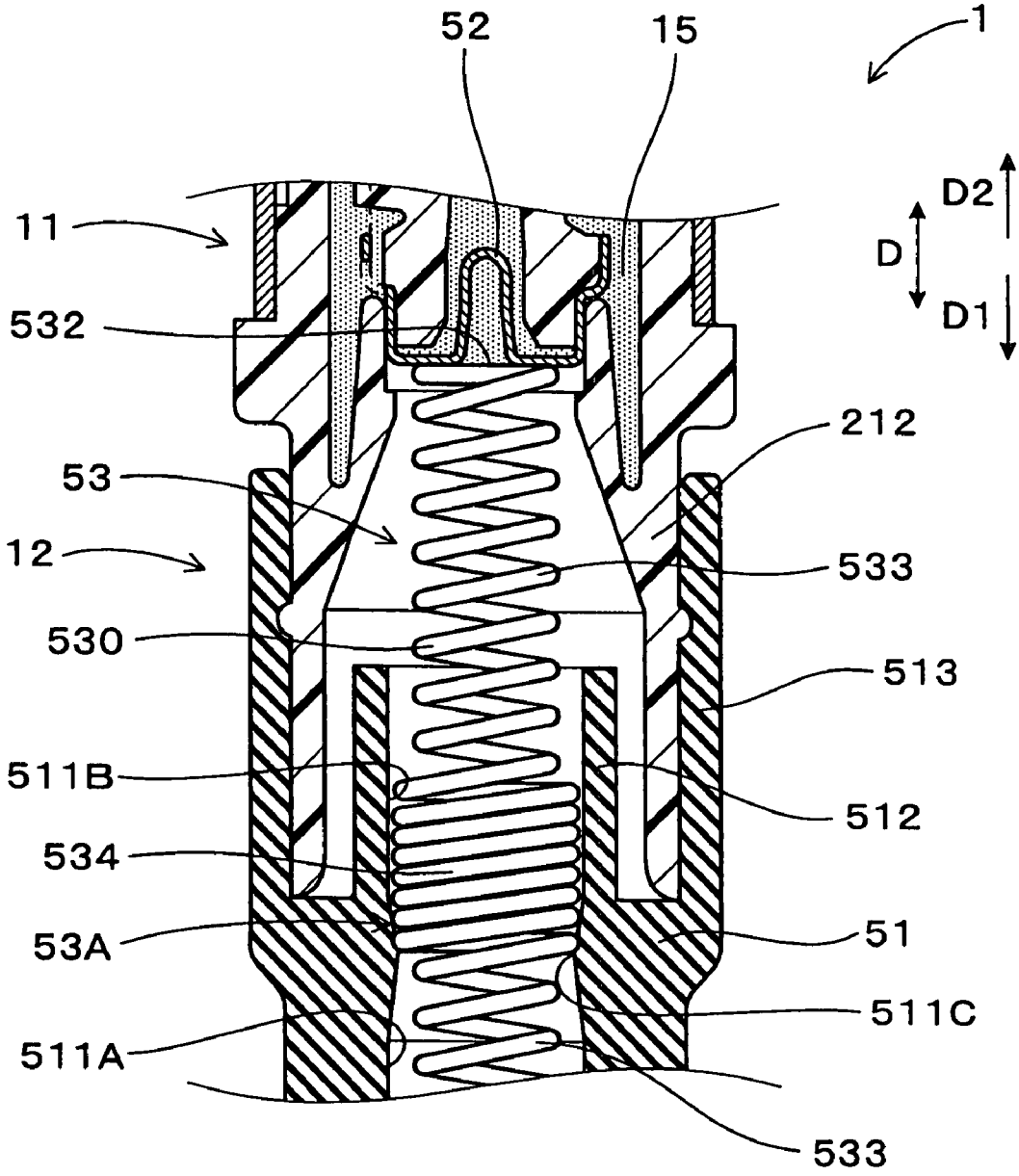
FIG. 3 is a sectional view showing a plug mount portion of an ignition coil according to a second embodiment.
Figure 4:
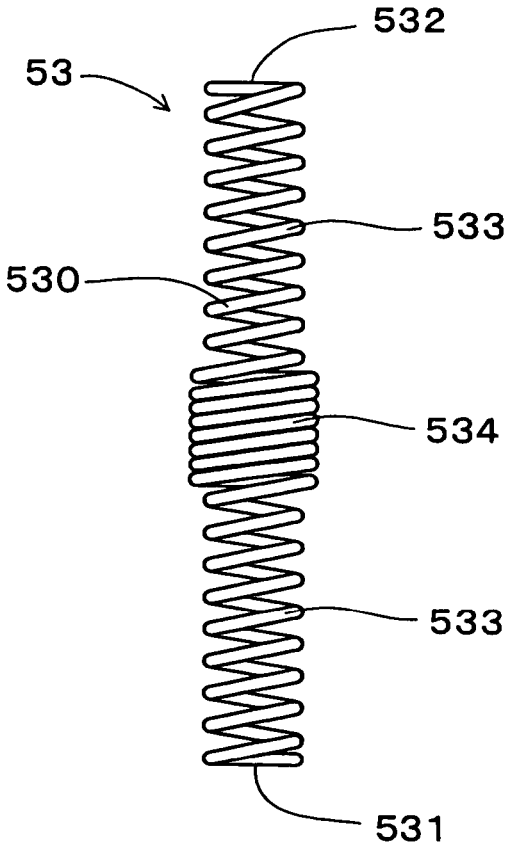
FIG. 4 is a side view showing a coil spring of the ignition coil according to the second embodiment.

In this example, as shown in FIGS. 3 to 6, the coil spring 53 has a structure for restricting the intermediate portion 53A from being radially deformed. Referring to FIGS. 3, 4, the coil spring 53 has a spaced winding portion 533 and a closed winding portion 534, which are formed by a winding steel wire with respect to the axial direction D. The spaced winding portion 533 is formed by winding a steel wire 530 with axial spaces between axially adjacent loops of the steel wire 530. The closed winding portion 534 is formed by winding the steel wire 530 with axial spaces, which are less than that of the spaced winding portion 533, between axially adjacent loops of the steel wire 530. The closed winding portion 534 is located at an intermediate position of the spaced winding portion 533. Mechanical strength of the intermediate portion 53A of the coil spring 53 is enhanced by forming the closed winding portion 534.

In this example, the outer diameter of the closed winding portion 534 is greater than the outer diameter of the spaced winding portion 533. In this example, the axial spaces of the closed winding portion 534 are small, and may be close to zero. The axially adjacent loops of the steel wire 530 are close to each other in the closed winding portion 534. Referring to FIG. 3, the spring support portion 512 has the inner circumferential periphery defining the fit portion 511A and the support portion 511B. The insulator portion 71 of the sparkplug 7 is inserted into the fit portion 511A. The small diameter portion 511C radially inwardly protrudes axially between the fit portion 511A and the support portion 511B in the fitting hole 511 of the plug cap 51. In this structure, the closed winding portion 534 of the coil spring 53 is inserted into the support portion 511B, so that the closed winding portion 534 hooks to the small diameter portion 511C. Thus, the coil spring 53 can be held in the fitting hole 511.

In this example of the ignition coil 1, the closed winding portion 534, which is excellent in mechanical strength, is held in the spring support portion 512. Therefore, the intermediate portion 53A of the coil spring 53 can be further effectively restricted from being radially deformed.

Figure 6:
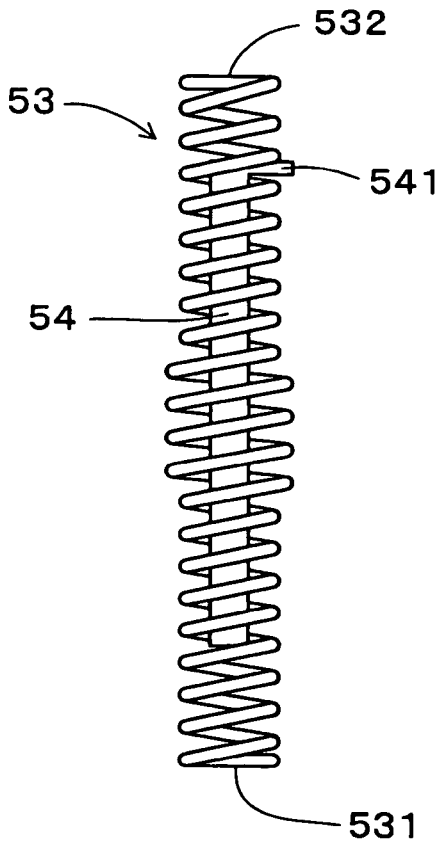
FIG. 6 is a side view showing a coil spring of the ignition coil according to the modification of the second embodiment.
Figure 5:
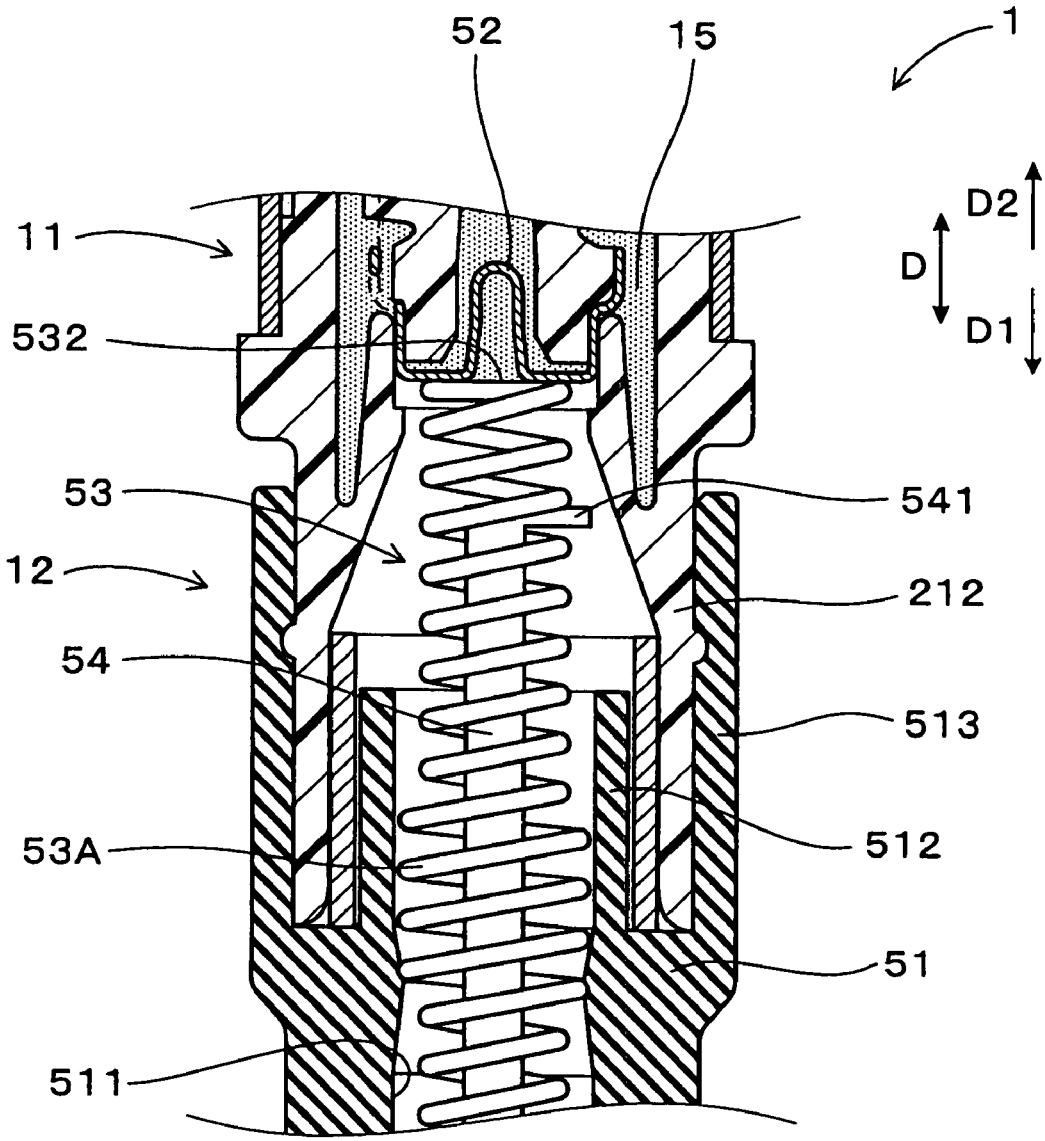
FIG. 5 is a side view showing a plug mount portion of an ignition coil according to a modification of the second embodiment.

As shown in FIGS. 5, 6, a guide bar 54 may be provided on the radially inner side of the coil spring 53 for reinforcing the coil spring 53. The guide bar 54 may be provided with a hook portion 541 for hooking to a part of the steel wire 530 constructing the coil spring 53. The hook portion 541 is hooked to the coil spring 53, so that the guide bar 54 can be held by the coil spring 53. The length of the guide bar 54 is determined such that the tip end of the guide bar 54 on the high voltage side D1 is not in contact with the terminal portion 72 of the sparkplug 7. In this structure, the guide bar 54 reinforces the coil spring 53, so that the intermediate portion 53A of the coil spring 53 can be further effectively restricted from being radially deformed. In this embodiment, the structure other than the above feature is similar to that in the first embodiment, so that the structure in this embodiment is capable of producing an effect similarly to the first embodiment.

Third Embodiment

Figure 7:
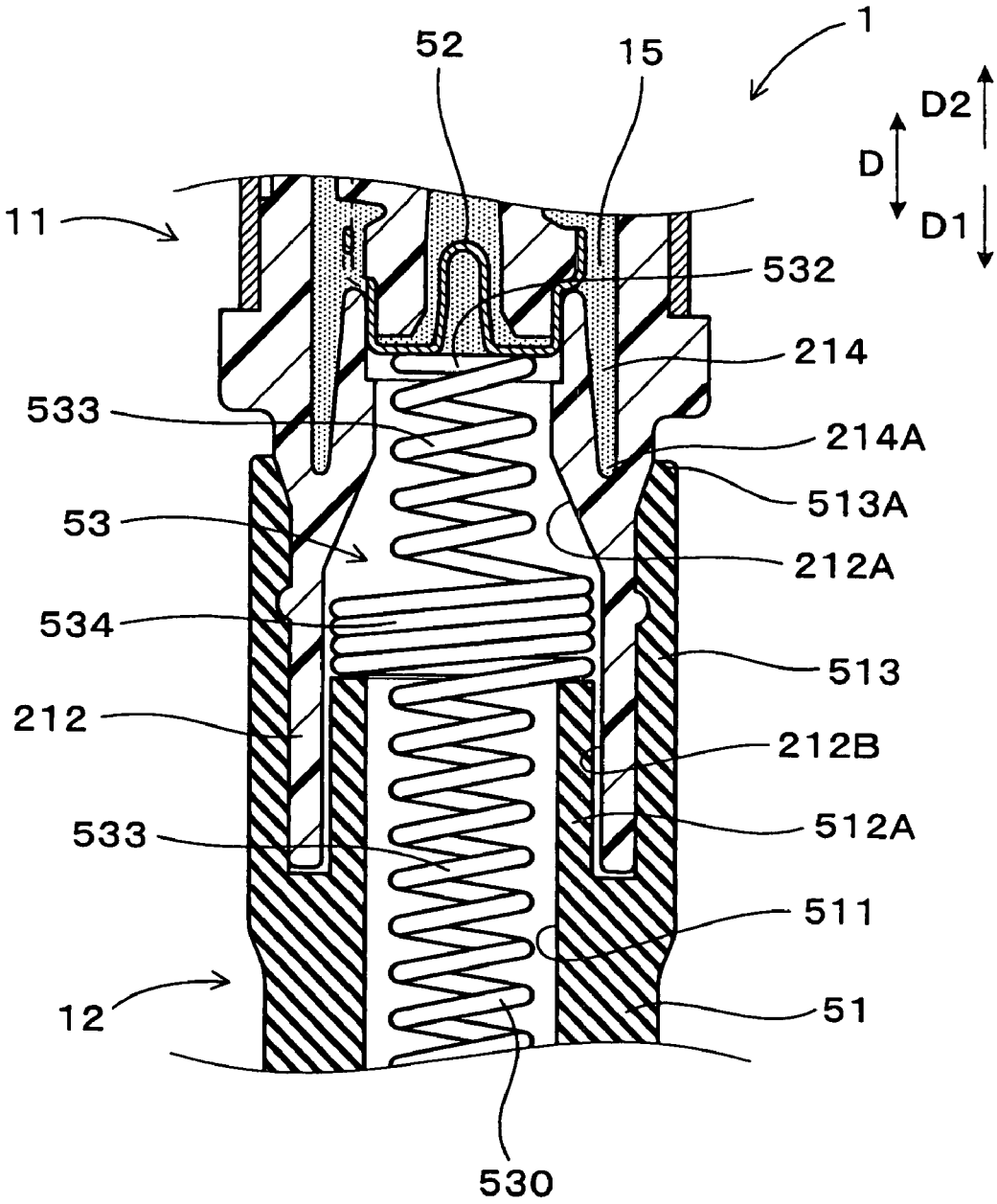
FIG. 7 is a sectional view showing a plug mount portion of an ignition coil according to a third embodiment.

In this example, as shown in FIG. 7, the coil spring 53 is partly supported by the inner circumferential periphery of the cap mount portion 212 of the plug mount portion 12. The inner circumferential periphery of the cap mount portion 212 includes a taper periphery portion 212A and a straight periphery portion 212B. The inner diameter of the taper periphery portion 212A increases toward the tip end on the high voltage side D1. The straight periphery portion 212B is located in the vicinity of the tip end of the cap mount portion 212 with respect to the taper periphery portion 212A. The straight periphery portion 212B extends substantially parallel with respect to the axial direction D.

The coil spring 53 has a spaced winding portion 533 and a closed winding portion 534, which are formed by a winding steel wire with respect to the axial direction D. The spaced winding portion 533 is formed by winding the steel wire 530 with axial spaces between axially adjacent loops of the steel wire 530. The closed winding portion 534 is formed by winding the steel wire 530 with axial spaces, which are less than that of the spaced winding portion 533, between axially adjacent loops of the steel wire 530. The closed winding portion 534 is located at an intermediate position of the spaced winding portion 533. In this example, the outer diameter of the closed winding portion 534 is greater than the outer diameter of the spaced winding portion 533. The axially adjacent loops of the steel wire 530 are close to each other in the closed winding portion 534.

A protruding support portion 512A is provided on the radially inner side of the circumferential mount portion 513. The protruding support portion 512A is in a substantially cylindrical shape extending toward the low voltage side D2 with respect to the axial direction D. The protruding support portion 512A is located on the radially inner side of the cap mount portion 212. The cap mount portion 212 has a substantially annular space 214 communicating with an inner gap of the coil case 33. The substantially annular space 214 is charged with the electrically insulative resin 15. The annular space 214, charged with the electrically insulative resin 15 has a high voltage end 214A, which is located on the high voltage side D1 relative to a low voltage end 513A of the circumferential mount portion 513 of the plug cap 51. The electrically insulative resin 15 charged in the annular space 214 defines a high voltage resin end 214A.

The protruding support portion 512A is radially opposed to the straight periphery portion 212B of the cap mount portion 212. The closed winding portion 534 of the coil spring 53 is located in a space axially away from the protruding support portion 512A. The spaced winding portion 533, which is located on the high voltage side D1 relative to the closed winding portion 534, is in the fitting hole 511 of the plug cap 51. In this example, the straight periphery portion 212B of the cap mount portion 212 supports the closed winding portion 534 of the coil spring 53. The closed winding portion 534 has an axial tip end supported by the end surface of the protruding support portion 512A of the plug cap 51 on the low voltage side D2.

In this example, the straight periphery portion 212B of the cap mount portion 212 supports the closed winding portion 534 of the coil spring 53. In this structure, the closed winding portion 534 of the coil spring 53 can be restricted from being radially deformed, so that electric contact between the coil spring 53 and the terminal portion 72 of the sparkplug 7 can be maintained. Even when the closed winding portion 534 of the coil spring 53 makes contact with the cap mount portion 212, the circumferential mount portion 513 of the plug cap 51, which is formed of rubber excellent in electrically insulative property, is located on the radially outer side of the cap mount portion 212 being in contact with the closed winding portion 534. Thus, high voltage electricity passing through the coil spring 53 can be restricted from leaking to low-voltage components. Thus, in this example, the ignition coil 1 having the stick coil structure is also capable of steadily maintaining electric conduction relative to the sparkplug 7.

Figure 8:
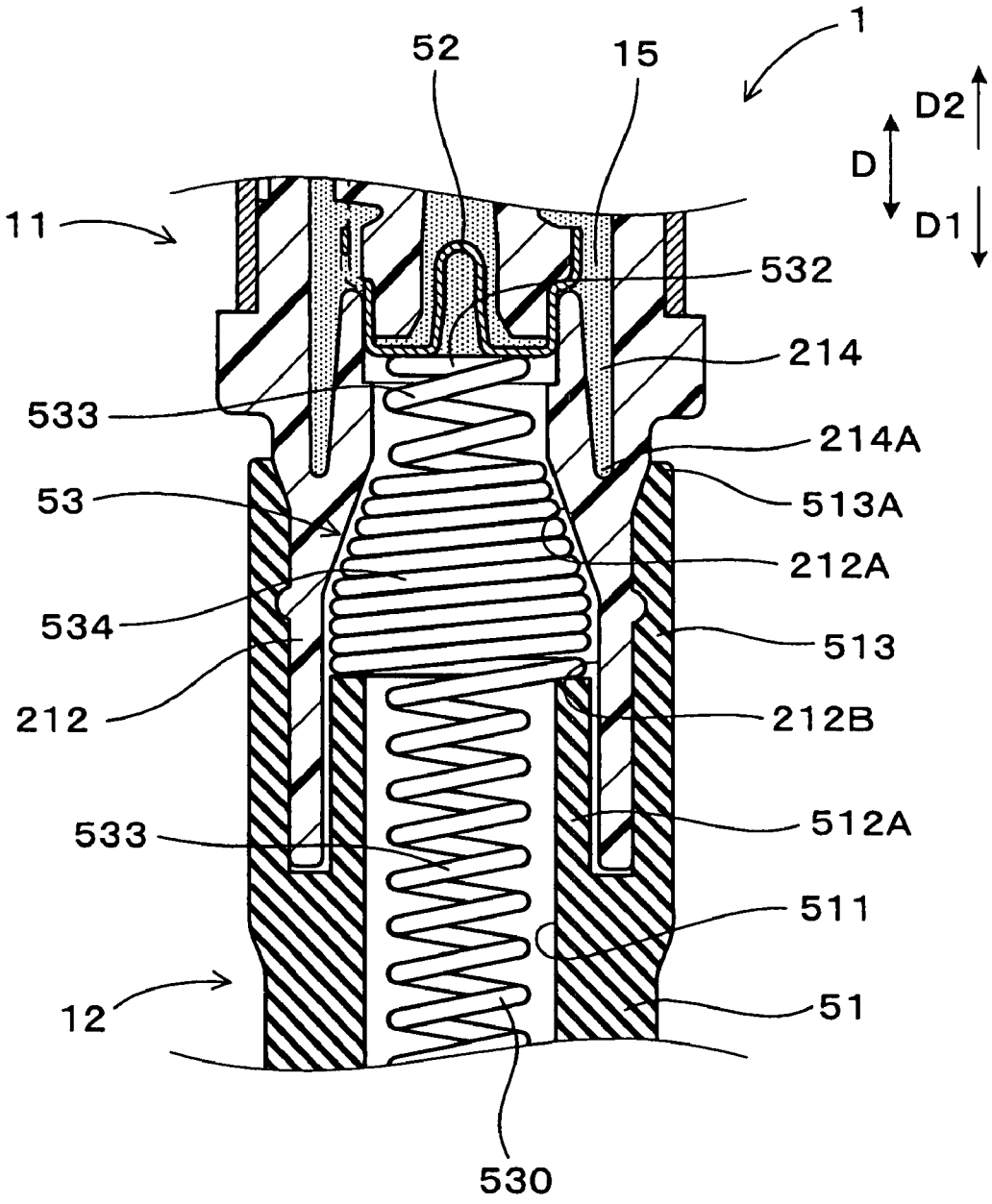
FIG. 8 is a sectional view showing a plug mount portion of an ignition coil according to a modification of the third embodiment.

As shown in FIG. 8, the closed winding portion 534 of the coil spring 53 may extend over the boundary between the taper periphery portion 212A and the straight periphery portion 212B of the cap mount portion 212. In this structure, both the taper periphery portion 212A and the straight periphery portion 212B support the closed winding portion 534 of the coil spring 53. The closed winding portion 534 is interposed between the taper periphery portion 212A and the end surface of the protruding support portion 512A on the low voltage side D2, thereby being restricted from moving with respect to the axial direction D and the radial direction thereof. In this structure, electric contact between the coil spring 53 and the terminal portion 72 of the sparkplug 7 can be further steadily maintained.

In addition, the annular space 214, which is charged with the electrically insulative resin being excellent in electrically insulative property, and the circumferential mount portion 513 of the plug cap 51, which is formed of rubber excellent in electrically insulative property, are located on the radially outer side of the taper periphery portion 212A and the straight periphery portion 212B. In this structure, even when the closed winding portion 534 makes contact with the taper periphery portion 212A and the straight periphery portion 212B, high voltage electricity passing through the coil spring 53 can be restricted from leaking to low-voltage components. In this embodiment, the structure other than the above feature is similar to that of the first embodiment, so that the structure in this embodiment is capable of producing an effect similarly to the first embodiment.

The above structures of the embodiments can be combined as appropriate.

Various modifications and alternations may be diversely made to the above embodiments without departing from the spirit of the present invention.

What is claimed is:

1. An ignition coil for a sparkplug of an engine, the ignition coil comprising:

a coil main body including a coil case accommodating a primary coil and a secondary coil;

a plug mount portion provided to a high voltage end of the coil main body, the plug mount portion having a cap mount portion being in a substantially cylindrical shape extending from a primary spool of the primary coil or the coil case;

a plug cap, which is formed of rubber and connected with the cap mount portion, the plug cap having a fitting hole in which an insulator portion of the sparkplug is to be inserted; and a coil spring inserted in the fitting hole for electrically connecting the sparkplug with a high voltage terminal, which is connected with a high voltage winding end of a winding of the secondary coil, wherein the plug mount portion and the coil main body are adapted to being inserted in a plughole of the engine, the coil spring has a low voltage end being electrically connected with the high voltage winding end of the secondary coil via the high voltage terminal, the coil spring has a high voltage end to be in contact with a terminal portion of a tip end of an insulator portion of the sparkplug, the coil spring has an intermediate portion between the low voltage end and the high voltage end, and the plug cap has a spring support portion defining a part of the fitting hole for restricting the intermediate portion of the coil spring from being radially deformed, wherein the coil spring has a spaced winding portion and a closed winding portion, which are formed by a winding steel wire to form a plurality of loops with respect to the axial direction, the spaced winding portion is formed by winding the steel wire with axial spaces between axially adjacent two of the plurality of loops of the steel wire, the closed winding portion is formed by winding the steel wire with axial spaces, which are less than the axial spaces of the spaced winding portion, between axially adjacent two of the plurality of loops of the steel wire, the closed winding portion is located at an intermediate position of the winding portion, the spring support portion supports the closed winding portion, the closed winding portion has an outer diameter greater than an outer diameter of the spaced winding portion, the plug cap has an inner circumferential periphery defining the fitting hole, the inner circumferential periphery of the plug cap has a small diameter portion radially inwardly protruding from the inner circumferential periphery of the plug cap, and the intermediate portion of the coil spring is hooked to the small diameter portion.

2. The ignition coil according to claim 1, wherein the plug cap has a circumferential mount portion, which is in a substantially cylindrical shape, and attached to an outer circumferential periphery of the cap mount portion, the spring support portion is in a substantially cylindrical shape protruding toward the low voltage side with respect to an axial direction, and the spring support portion is located on a radially inner side of the circumferential mount portion.

3. The ignition coil according to claim 1, further comprising:

a guide bar located on a radially inner side of the coil spring for reinforcing the coil spring.

4. The ignition coil according to claim 1, further comprising:

a reinforce member provided with the spring support portion, wherein the reinforce member has hardness greater than hardness of a rubber material constructing the spring support portion.

5. The ignition coil according to claim 4, wherein the reinforce member surrounds an outer circumferential periphery of the spring support portion.

6. The ignition coil according to claim 1, wherein axially adjacent two of the plurality of loops are close to each other in the closed winding portion.

7. The ignition coil according to claim 1, wherein the small diameter portion is located axially midway through the plug cap.

8. The ignition coil according to claim 1, wherein the spring support portion has an inner circumferential periphery defining a first portion and a second portion, which therebetween define the small diameter portion with respect to an axial direction of the spring support portion, and the small diameter portion radially inwardly protrudes from both the first portion and the second portion.

9. The ignition coil according to claim 8, wherein the small diameter portion has an inner diameter, which is less than inner diameters of the first portion and the second portion, and the closed winding portion is in contact with the small diameter portion and supported by the small diameter portion in at least one of an axial direction of the closed winding portion and a radial direction of the closed winding portion.

10. The ignition coil according to claim 9, wherein the closed winding portion is at least partially spaced from the first portion and the second portion with respect to the radial direction.

11. The ignition coil according to claim 1, wherein the coil spring further has a lower spaced winding portion formed by winding the steel wire with axial spaces between axially adjacent two of the plurality of loops of the steel wire, the closed winding portion is formed by winding the steel wire with the axial spaces, which are less than the axial spaces of the first and lower spaced winding portions, and the closed winding portion is axially located between the spaced winding portions and lower spaced winding portions.

12. The ignition coil according to claim 1, wherein each of the axial spaces of the closed winding portion is substantially zero.

13. The ignition coil according to claim 1, wherein the spring support portion is in a substantially cylindrical shape and located radially inside of the cap mount portion, the spring support portion and the cap mount portion therebetween define an annular gap, and the closed winding portion and the annular gap at least partially overlap one another with respect to a radial direction.

14. The ignition coil according to claim 13, wherein the plug cap has a mount portion, which is substantially in a cylindrical shape and attached to an outer circumferential periphery of the cap mount portion, the spring support portion is in a substantially cylindrical shape axially protruding toward the low voltage side, and the cap mount portion is located between the spring support portion and the mount portion with respect to the radial direction.

* * * * *